United States Patent [19]

Piper

[11] 4,357,559

[45] Nov. 2, 1982

[54] FLUORESCENT LAMP UTILIZING PHOSPHOR COMBINATION

[75] Inventor: William W. Piper, Scotia, N.Y.

[73] Assignee: General Electric Company, Schenectady, N.Y.

[21] Appl. No.: 130,997

[22] Filed: Mar. 17, 1980

[51] Int. Cl.[3] ..... H05B 41/16; H05B 41/24

[52] U.S. Cl. ..... 315/248; 313/458; 313/487

[58] Field of Search ..... 313/485, 487, 498, 486; 315/248

[56] References Cited

U.S. PATENT DOCUMENTS 3,875,453 4/1975 Thornton, Jr. ..... 313/487
4,069,441 1/1978 Wanmaker et al. ..... 313/487
4,176,294 11/1979 Thornton, Jr. ..... 313/487
4,263,530 4/1981 Van Broekhoven ..... 313/487

*Primary Examiner*—Saxfield Chatmon, Jr.
*Attorney, Agent, or Firm*—John F. McDevitt; Philip L. Schlamp; Fred Jacob

[57] ABSTRACT

A fluorescent lamp construction is described utilizing a particular combination of two different phosphor materials in order to produce more efficient emission of white color light and whose color temperature can be controlled. The particular phosphor combination can be utilized as a blended mixture; and the color point of the lamp emission can be adjusted to approximate black body radiation emission such as incandescent lamp emission with negligible loss in optimum luminous efficacy.

8 Claims, 2 Drawing Figures

FLUORESCENT LAMP UTILIZING PHOSPHOR COMBINATION

BACKGROUND OF THE INVENTION

The present invention relates generally to fluorescent lamps operating at very high discharge power density which utilize an evacuable light transmissive envelope coated with phosphor and a gaseous medium within said envelope which can be ionized to excite mercury atoms which emit ultraviolet radiation as well as visible emission of a blue color. In one such type fluorescent lamp, said gaseous medium is ionized by electromagnetic coupling to a source of radio frequency energy, preferably of 50 to 500 kilohertz frequency. A ferrite core located either within or outside the discharge envelope can provide said electromagnetic coupling and the radio frequency energy source may be a solid state oscillator circuit producing a relatively low voltage. A typical lamp of this type includes an evacuable light transmissive envelope coated with phosphor and having a gaseous medium containing mercury vapor within said envelope and which upon excitation by an electric field emits ultraviolet radiation as well as visible radiation of an overall blue color. The structural features of said lamps are described in U.S. Pat. Nos. 4,017,764 and 4,176,296, to Anderson, as well as other U.S. patents referenced therein, all assigned to the present assignee. The operating principles for said lamps are further disclosed in U.S. Pat. Nos. 3,500,118 and 3,521,120, also assigned to the present assignee. Said type lamp is also compact in nature employing a globular shaped envelope with a similar volume as an incandescent lamp and is operated without electrodes, the discharge being induced by the magnetic core at a very high discharge power density. This lamp is adapted to replace incandescent lamps for more efficient generation of white light. As illustrative of the luminous efficacy achieved with one such type prior art electrodeless fluorescent lamp, a 30 watt size lamp is described in the aforementioned U.S. Pat. No. 3,521,120 as demonstrating a luminous efficacy of approximately 40 lumens per watt at an operating temperature of 40° C. with a conventional calcium fluorophosphate phosphor coating which is about three times the luminous efficacy of an incandescent lamp with equal lumen output.

It has also long been recognized that the operating temperature of a conventional tubular type low pressure mercury fluorescent lamp can have a significant effect on luminous efficacy. In said conventional fluorescent lamps, the coldest spot on the lamp wall determines the operating characteristic to a significant degree and is the location where excess mercury condenses. The "cold spot" temperature controls mercury vapor pressure inside the lamp increasing or decreasing the amount of ultraviolet radiation available to excite the phosphor coating. Such conventional fluorescent lamps are generally designed to peak in light output at a cold spot temperature of around 42° C. at which temperature the mercury pressure is about 7 millitorr. Above this value too much mercury vapor is present in the lamp, and some ultraviolet radiation is reabsorbed inefficiently with a subsequent reduction in phosphor excitation per unit of input power. It is further not uncommon when said conventional lamps operate above said optimum cold spot temperature to experience a loss in luminous efficacy of as much as 15–25% and greater. Since the visible mercury vapor radiation escaping through the phosphor coated wall of the lamp envelope in said conventional tubular lamps is usually less than 10% of the total visible emission, however, the white color point of said lamp emission does not change appreciably with variation in the cold spot temperature.

As distinct from the foregoing described operating characteristics of a conventional tubular type fluorescent lamp, as the power density in the mercury discharge is increased, the fraction of the total radiation power from the discharge which is visible radiation also increases. This is understood as being due to a partial saturation of the ultraviolet emission of mercury atoms whereas the visible emission rises in a more nearly linear fashion. As a consequence at very high power densities the visible discharge radiation can amount to 25 to 35% of the total visible emission. Furthermore the efficiency for converting electric power into visible radiation continues to increase well above the aforementioned mercury vapor pressure of 7 millitorr. The overall luminous efficacy for such a lamp therefore attains a maximum value at a significantly higher mercury vapor pressure and cold spot temperature. A further consequence is that the overall lamp luminous efficacy decreases as the power density is increased. Of even more significance to this invention, the overall lamp color point depends significantly on both the power density of the discharge and the temperature of the cold spot.

It is also known to utilize phosphor combinations of various kinds in the conventional fluorescent lamp construction of a tubular type wherein either blended mixtures of the individual phosphor constituents or even multiple layers of the individual phosphor constituents, including mixtures thereof, are utilized. For example, there is described in U.S. Pat. No. 4,075,532 to Piper et al, also assigned to the present assignee, a phosphor blend utilizing a first phosphor having a relatively narrow emission band peaking in the short visible wavelength (blue) region and a second phosphor having the relatively broad band emission peaking in the 570–600 nanometer (yellow) region of the visible spectrum which provides improved luminous efficacy in this type fluorescent lamp construction. As further illustrative of a different phosphor combination producing white light more efficiently than conventional deluxe type fluorescent lamps of a tubular type construction, there is described in U.S. Pat. No. 4,079,287 issued to Soules et al and assigned to the present assignee, the phosphor blend utilizing a strontium haloapatite phosphor and a europium-activated yttrium oxide phosphor. A still different phosphor combination said to produce warm white color light efficiently in said conventional low pressure fluorescent lamp is described in U.S. Pat. No. 4,088,923 as a blended mixture of two magnesium aluminate phosphors with a hexagonal crystal structure and activated with specific rare earth ions and a third phosphor of yttrium oxide activated with trivalent europium.

The warm white color generally sought in these lamps for a direct replacement of incandescent lamps at a far greater luminous efficacy cannot be achieved with conventional halophosphates, such as calcium haloapatite phosphor, or even with more recently developed phosphor combinations utilizing various halophosphate phosphor components above a certain level of discharge power density. Primarily, said phosphor materials lack color points which can be adjusted to compensate for the significant visible mercury vapor radiation being emitted from said higher power density fluorescent lamps to produce lamp emission of a warm white color. If the cold spot temperature is reduced below the aforementioned operating temperatures to produce a white color point for the lamp emission closer to a warm white color, there is experienced an unacceptable loss in luminous efficacy. There is further experienced a much greater lumen depreciation during a lifetime in said lamps than occurs in the tubular fluorescent lamps using the same conventional halophosphate phosphors and which becomes more pronounced at high discharge power density of lamp operation. Accordingly, an improved phosphor is desired permitting a high power density fluorescent lamp such as the electrodeless lamp to operate with acceptable lumen efficacy during its lifetime and which can also produce various white color points for the lamp emission by adjustment of the operating cold spot temperature.

SUMMARY OF THE INVENTION

It has now been discovered, surprisingly, that a particular phosphor combination can be used in a high power density fluorescent lamp of the type above generally described to produce white light emission of lower color temperature at a given discharge power density and which can do so without experiencing undue lumen depreciation. The color point of the present fluorescent lamp can be adjusted and a means of controlling the mercury vapor pressure in said lamp is provided to control the color temperature of lamp operation. The present phosphor combination further permits adjustment of the lamp emission color point by variation of the lamp cold spot temperature to achieve color temperatures from approximately 2600° K. to approximately 4500° K. Said improvement thereby generally comprises a higher power density fluorescent lamp such as the electrodeless fluorescent lamp having an evacuable light transmissive envelope coated with phosphor and a gaseous medium containing mercury vapor within said envelope which can be ionized by an electric field to emit ultraviolet radiation as well as visible radiation of an overall blue color, wherein the improvement comprises using a phosphor blend comprising a europium-activated rare earth oxide phosphor with a narrow band green emitting phosphor such as cerium and terbium activated magnesium aluminate phosphor having a hexagonal crystal structure, said phosphor combination producing composite lamp emission of a white color. A different narrow band green emitting phosphor having a peak wavelength at approximately 527 nanometers wavelength which is deemed useful is zinc silicate activated with manganese. The desired emission spectrum for said green emitting phosphor constituent is a narrow principal emission band with a mean wavelength in the green portion of the spectrum between the wavelengths of 525 and 570 nanometers wavelength.

By varying the cold spot temperature of lamp operation in said improved lamp construction, the blue color emission resulting from the mercury vapor radiation escaping from the lamp is adjusted so that a warm white color of lamp emission can be achieved efficiently as well as other recognized white color points. Luminous efficacies of 70 lumens per watt or greater have been achieved in this manner at the desired white color point and with the lumen depreciation during several thousand hours of lamp operation not exceeding commercial requirements. It can be further noted that said improved phosphor can provide a desired color temperature at higher power density operation than can any of the previously employed commercial phosphors. Useful europium activated rare earth oxide phosphors for the practice of the present invention are well-known such as disclosed in U.S. Pat. No. 3,301,791 to Brixner and with said useful phosphors exhibiting both good quantum efficiency even at elevated temperatures of 200°–300° C. along with superior lumen maintenance when excited with ultraviolet radiation being emitted from the mercury vapor discharge. Preferred cerium and terbium activated rare earth magnesium aluminate phosphors for practice of the present invention which exhibit corresponding operating characteristics are disclosed in the aforementioned U.S. Pat. No. 4,088,923 and others. Satisfactory performance at elevated temperature is a necessary attribute inasmuch as such high power density fluorescent lamp operates with a relatively high envelope temperature. The useful class of these preferred phosphor materials can be represented by the following formula:

$$Ce_{1-x}Tb_xMgAl_{11}O_{19}$$

where X is in the approximate range 0.2–0.5, said phosphors all having a hexagonal crystal structure and being more particularly described along with preparation in Dutch Patent Application No. 7,214,862. The useful europium activated rare earth oxide phosphors can also be represented by a structural formula as follows:

$$[Eu_aR_{(1-a)}]_2O_3$$

where

R is a rare earth element selected from yttrium and gadolinium, a is in the approximate range 0.02–0.07.

In one preferred embodiment exhibiting a lamp emission color point adjacent or within the standard "warm white" oval a uniformly blended mixture comprising approximately 25–30 percent by weight of europium activated yttrium oxide phosphor with 70–75 percent by weight of said cerium and terbium activated magnesium aluminate phosphor achieved 70 lumens per watt efficiency at the start of the lamp tests in a 35 watt size electrodeless lamp and further exceeded lumen maintenance specifications established for this particular lamp. The method of operating said lamp construction to vary the white color point of lamp emission is more fully described hereinafter in connection with the following detailed description.

DESCRIPTION OF THE PREFERRED EMBODIMENTS

Figure 1:
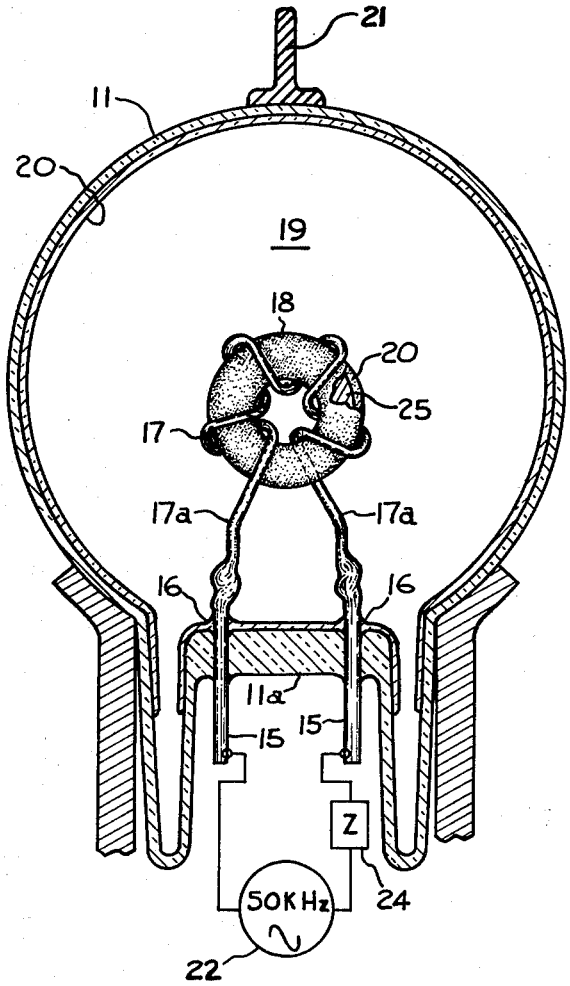
FIG. 1 is a partial cross sectional side elevation view of a preferred lamp embodiment in accordance with the present invention in which magnetic core means are disposed entirely within the lamp envelope.

There is illustrated in FIG. 1 a typical solenoidal electric field lamp in which the core is disposed entirely within the lamp envelope containing the gaseous discharge medium. Referring to said drawing, a substantially globular or teardrop-shaped evacuable lamp envelope 11, which may be glass, is formed using techniques well-known to the lamp art. One portion of the lamp envelope forms space 11*a* which is pierced by two metallic support rods 15 which are bonded to the glass, in any conventional manner, to form vacuum seals 16. A winding of electrically conductive material 17 which may be insulated with, for example, glass fiber cloth, is connected between the metallic support rods 15 and linked through a closed loop magnetic transformer core 18 which is thereby supported within the lamp envelope 11. In this embodiment winding ends 17*a* are oriented to position the axis of the core 18 perpendicular to support rods 5. The specific winding configuration is determined by the operating input voltage to the lamp. Typically the windings may be chosen to allow one turn on the core for each five volts of winding input voltage. The space within the envelope contains an ionizable gas 19 which may be chemically identical with that used in conventional fluorescent lamps and may comprise a mixture of a rare gas, for example krypton and/or argon, with mercury vapor. The internal surface of the glass envelope 11 and the external surfaces of the transformer 18 are coated with the phosphor combination 20 in accordance with the present invention. Upon stimulation of said phosphor coating by ultraviolet radiation generated from the mercury vapor discharge, there is emitted visible radiation of a yellowish color in a highly efficient manner. Additionally, in said lamp construction, the gaseous medium may produce bluish radiation which comprises approximately 25–35 percent of the total lumen emission in the current design of 35 watt size lamps.

A heat sink 21, metallic or otherwise, is placed in good thermal contact with an appropriate area on the envelope 11 such that by controlling the thermal environment of said sink its temperature can be adjusted to be the coldest spot on envelope 11. By adjusting the temperature of said heat sink, the vapor pressure of the mercury in the gas medium 19 can thus be controlled.

The ratio of the power of yellowish radiation emanating from the phosphor 20 to the power of bluish radiation emanating directly from the visible mercury vapor discharge can thus be adjusted by changing the heat sink temperature.

The source of radiofrequency electrical power 22 mounted external to the lamp envelope, and preferably within the base assembly causes current to flow through the support rods 15 and transformer primary winding 17 thereby energizing the core with a magnetic field. The core induces an electrical current flow in the gas 19, ionizing that gas and stimulating the emission of ultraviolet radiation primarily at 254 and 185 nanometers wavelength which efficiently excites phosphor 20 and also stimulating the emission of mercury radiation from the gas 19 at the visible wavelengths of 405, 436, 546 and 578 nanometers. In a manner typical of conventional discharge lamps, the ionized gas presents a negative impedance electrical load which would destroy an unprotected low impedance power source. A ballast impedance 24 may, for example, be connected in series with power source 22 and a support rod 15 in a conventional manner, to provide sufficient positive impedance to balance the negative impedance of the gaseous medium so as to present the power supply with a positive impedance load; assuring stable operation. Alternately, current limiting means may be built into the power source 22 to provide an active ballasting function. Since a more detailed description of said above solenoidal electric field lamp is found in the aforementioned U.S. Pat. No. 4,017,764 said referenced patent is hereby incorporated in the present specification to avoid need for any further description herein of the basic lamp construction.

To more fully illustrate the improvement obtained in emission behavior for the above type lamp construction utilizing the present phosphor combination as a blended mixture, various 35 watt size lamps were constructed for comparison of the variation in color point of the lamp emission which is produced with variation in the operating cold spot temperature. Said 35 watt size lamps were constructed with an average phosphor coating weight of approximately 4 milligrams per square centimeter of phosphor coating area and the gaseous medium in said lamps was provided with krypton gas at approximately 500 millitorr pressure and about 10 milligrams of mercury which was amalgemated with an alloy of bismuth tin and lead to depress the mercury vapor pressure at a given cold spot temperature was inserted under the cold spot area.

The particular phosphor combination employed in said lamp tests consisted of a blended mixture utilizing 74 parts by weight of a first phosphor having the structural formula:

$$Ce_{0.7}Tb_{0.3}MgAl_{11}O_{19}$$

with 26 parts by weight of a second phosphor having the structural formula:

$$(Eu_{0.05}Y_{0.95})_2O_3$$

and said blended phosphor mixture was applied to the interior surface of said 3½ inch diameter lamp globe in the customary manner. Subsequent operation of said test lamps in accordance with the present invention produced a variation in color points of lamp emission as measured by the well-known C.I.E. method as shown in FIG. 2.

Figure 2:
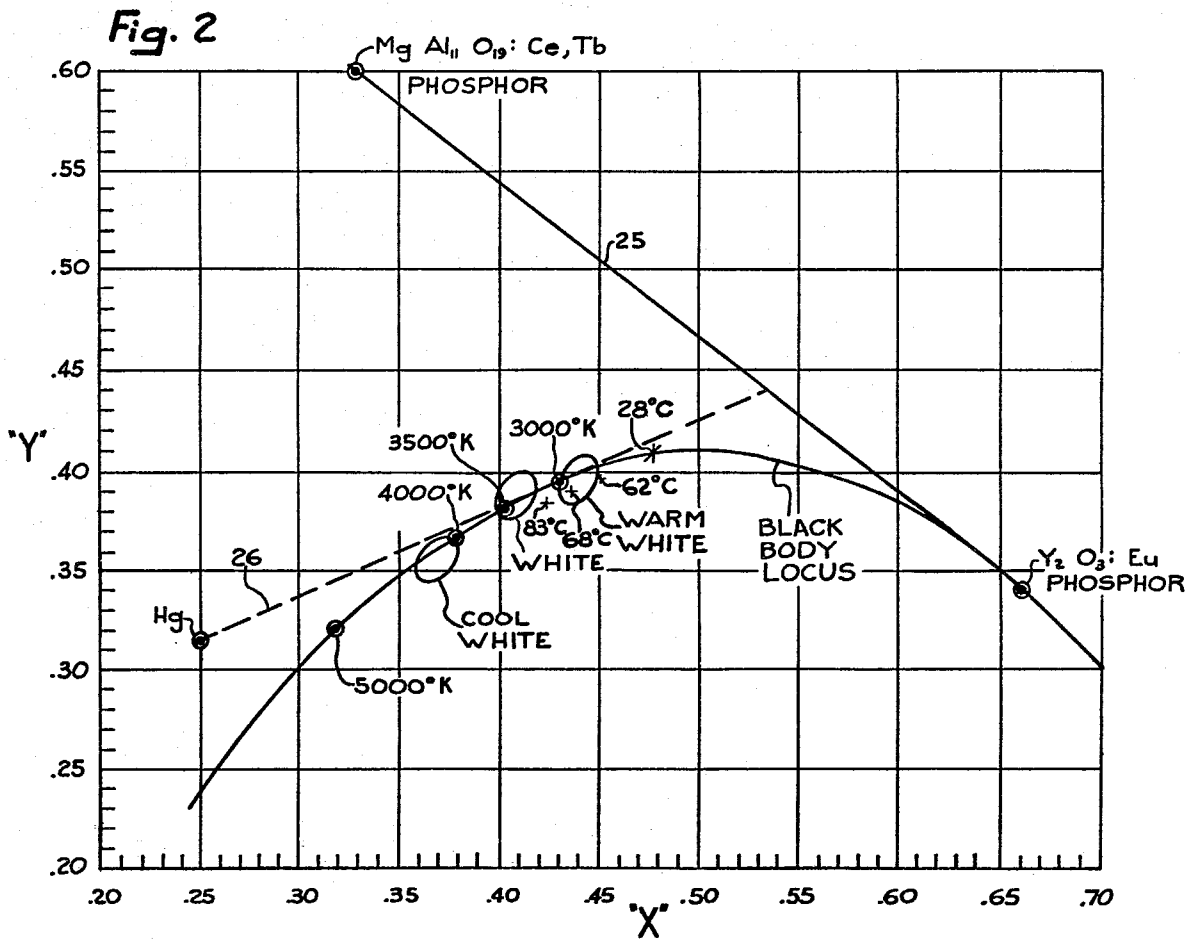
FIG. 2 is a C.I.E., (X,Y) chromaticity diagram illustrating operating principles of the present invention.

Referring to said FIG. 2, there is shown a portion of the C.I.E. chromaticity diagram including the black body locus line along with certain of the ANSI defined white color ovals employed as color standards for fluorescent type lamps as well as certain color points measured upon the present test lamps. There is still further included in said diagram the color points for the two phosphor constituents being used in said test lamps along with the color point of the visible mercury vapor radiation escaping from these lamps. By establishing said latter three color points on the chromaticity diagram in FIG. 2, there is further defined an operative relationship therebetween which determines the extent of shift in color point for the lamp emission with variation in the cold spot temperature of lamp operation. More particularly, said operative relationship is established by first locating the color point on the customary blend line 25 for the present phosphor combination and thereafter providing a second blend line 26 which extends between said color point and the color point of the escaping mercury vapor radiation. The shift in color point of the lamp emission with variation in the cold spot temperature of lamp operation takes place along or adjacent to said blend line 26 which can be noted from said chromaticity diagram to lie close to all of the standard white color ovals therein shown. As is further provided on said chromaticity diagram, four color points are shown for said test lamps when operated at cold spot temperatures of 28° C., 62° C. 68° C. and 83° C. It becomes thereby possible with the present phosphor combination not only to achieve color points in this manner which reside within the warm white color oval but to shift the desired color point of lamp emission to the remaining color ovals shown over a wide color temperature range extending between about 2600° K. to approximately 4500° K.

From the above preferred embodiments, it is also evident that a particular two-component phosphor combination has been provided which achieves significantly lower color temperature than with conventional phosphor materials heretofore employed in high power density type fluorescent lamps. It will also be apparent, however, that some modification can be made in the illustrated embodiments by compositional variation of the phosphor constituents without departing from the true spirit and scope of this invention. Additionally, variations in the lamp construction per se are contemplated so that the present invention is intended to be limited only by the scope of the appended claims.

What I claim as new and desire to secure by United States Letters Patent is:

1. In a high pressure mercury vapor type fluorescent lamp having an evacuable light transmissive envelope coated with phosphor, a gaseous medium containing mercury vapor within said envelope which can be excited by an electromagnetic field at a very high discharge power density to produce a mercury vapor pressure in excess of 7 millitorr and emit ultraviolet radiation as well as visible radiation of an overall blue color, said visible radiation constituting at least 25% of the total visible lamp emission, the improvement which comprises using a blended mixture comprising a europium activated rare earth oxide phosphor with a second phosphor having a narrow principal emission band with a mean wavelength in the green portion of the spectrum between the wavelengths of 525 and 570 nanometers, said phosphor combination producing composite lamp emission of a white color when exposed directly to said gaseous medium.

2. A lamp as in claim 1 wherein the color point of the white lamp emission is adjusted by controlling the mercury vapor pressure in the lamp.

3. A lamp as in claim 2 wherein the mercury vapor pressure in the lamp is controlled by the cold spot temperature of lamp operation.

4. A lamp as in claim 1 wherein the envelope is globular shaped and the electric field is generated by a magnetic core.

5. A lamp as in claim 1 wherein the second phosphor is an aluminate phosphor as follows:

$$Ce_{1-x}Tb_xMgAl_{11}O_{19}$$

where x is in the approximate range 0.2–0.5.

6. A lamp as in claim 1 wherein the rare earth oxide phosphor is:

$$[Eu_aR_{(1-a)}]_2O_3$$

where R is a rare earth element selected from yttrium and gadolinium and a is in the approximate range 0.02–0.07.

7. A lamp as in claim 5 wherein the blended phosphor mixture is in parts by weight 70–75 parts of the aluminate phosphor and 25–30 parts of a rare earth oxide phosphor as follows:

$$[Eu_aY_{(1-a)}]_2O_3$$

where a in in the approximate range 0.02–0.07.

8. A lamp as in claim 1 wherein the color point of the white color lamp emission resides within the standard warm white color oval.

* * * * *